US005557810A

United States Patent [19]

Antos et al.

[11] Patent Number: 5,557,810

[45] Date of Patent: Sep. 24, 1996

[54] PORTABLE TOILET WITH BATTERY OPERATED FLUSH ASSEMBLY

[75] Inventors: John M. Antos, Ann Arbor; John R. Selina, Brighton; James M. Byrne, Ann Arbor, all of Mich.

[73] Assignee: Thetford Corporation, Ann Arbor, Mich.

[21] Appl. No.: 295,245

[22] Filed: Aug. 24, 1994

[51] Int. Cl.[6] ..... E03D 1/24; E03D 5/10

[52] U.S. Cl. ..... 4/321; 4/323

[58] Field of Search ..... 4/321, 322, 323, 4/329

[56] References Cited

U.S. PATENT DOCUMENTS

| | | | |
|---|---|---|---|
| 3,172,131 | 3/1965 | Herkenhine et al. | 4/321 |
| 3,289,214 | 12/1966 | Corliss | 4/321 |
| 3,570,018 | 3/1971 | Sargent et al. | 4/323 |
| 3,747,130 | 7/1973 | Sargent et al. | 4/321 |
| 3,949,430 | 4/1976 | Miller et al. | 4/321 |
| 4,180,876 | 1/1980 | Sargent et al. | 4/321 |
| 4,185,337 | 1/1980 | Sargent et al. | 4/321 |
| 4,926,508 | 5/1990 | Sargent et al. | 4/321 |
| 5,010,602 | 4/1991 | Sargent et al. | 4/321 |

*Primary Examiner*—Henry J. Recla
*Assistant Examiner*—Charles R. Eloshway
*Attorney, Agent, or Firm*—Harness, Dickey & Pierce, P.L.C.

[57] ABSTRACT

A battery operated flush assembly for a portable toilet. The flush assembly includes a pump and motor mounted to the toilet's seat section. A battery pack is removably mounted to the seat section and includes terminals which, as a result of mounting, become coupled to the motor. The battery pack supplies electrical power to the motor and includes an actuator, protected from inadvertent actuation within a recess, for electrically closing the electrical circuit and causing operation of the pump to discharge flush water into the bowl. A check valve, located in-line with the discharged flush water, opens in response to the pumping of flush water and is maintained open with minimal line pressure to increase the life of the battery pack. An O-ring is also used to ensure that the battery pack can be easily removed and reinstalled with a fluid tight seal therearound.

5 Claims, 5 Drawing Sheets

PORTABLE TOILET WITH BATTERY OPERATED FLUSH ASSEMBLY

BACKGROUND OF THE INVENTION

This invention generally relates to portable toilets and more particularly relates to a portable toilet which carries its own power supply for operating the flush assembly. Portable toilets of the general type to which this invention relates are typically provided with either a manually or electrically operated pump for pumping flush water from a water storage tank into the toilet bowl. It is the latter variety to which this invention particularly relates.

U.S. Pat. No. 4,185,337, assigned to the assignee of the present application, shows a portable toilet with an electrically operated flush assembly. The flush assembly illustrated in this patent requires an external source of power and involves a continuous flush which has limitations from the standpoint of flush water efficiency. U.S. Pat. No. 4,926,508, also assigned to the assignee of the present application, shows a portable toilet with a power assisted flush assembly which is operated off of batteries carried by the toilet itself. This battery operated assembly is flushed by depressing a hollow cap member, known as a palm button because it is intended to be depressed with the palm of a hand, which is mechanically connected to a valve that opens in response to depression of the palm button and which cause the pumping of flush water.

One of the hazards involved in using a portable toilet is the possibility of flush water being inadvertently spilled when the toilet is not in use, such as during transportation. Unless the flush water is blocked from flowing into the bowl, the flush water will inevitably leak into the bowl while the toilet is being transported. To prevent this from happening, a spring biased check valve is incorporated into the flow path between the pump and the toilet bowl. In a toilet with a manually operated flush mechanism, such a restriction is not objectionable because the same large force necessary to operate the manual flush assembly is sufficient to open the check valve and achieve good flushing of the toilet. In a battery operated assembly, such a check valve is not used. Rather, a valve mechanism which is manually opened during initiation of a flush by the same actuator movement that closes the battery switch to power the flushing operation is used. This reduces the demands on the battery. In this manner, the electrically operated assembly can be made to use as little power as possible during flushing and thereby decrease the frequency with which the batteries must be changed. This construction, however, increases the cost of the battery operated flush assembly and further requires that numerous additional or alterative production steps be used when constructing the toilet with the battery operated flush assembly as opposed to the manually operable flush assembly.

Another limitation of the electrically or battery operable flush assembly is that changing the batteries associated with the portable toilet can be a complicated event that may require specific tools or numerous procedures. Once the, batteries have been replaced, it is important to ensure that when remounted within the flush assembly, the batteries are easily isolated by the establishment of a fluid-tight seal.

In view of the above and other limitations, a principle object of this invention is to provide an improved battery operated flush assembly for portable toilets which does not require manual opening of a closure associated with the discharging of flush water.

Another object of this invention is to provide a battery operated flush assembly which has a simplified construction that readily permits in-the-field replacement of the batteries and the reestablishment of a fluid-tight seal around the batteries.

A further object of this invention is to provide an improved battery flush assembly adapted for use with a check valve located in-line between the pump and the discharge nozzle of the portable toilet. The battery operated flush assembly of this invention does not require a manual closure to ensure that flush water does not leak into the bowl of the toilet.

SUMMARY OF THE INVENTION

In achieving the above and other objects, the present invention provides for a portable toilet which includes a flush assembly operated by batteries carried by the toilet. The toilet is therefore truly portable. Generally, the toilet includes a seat section which is mounted to a waste holding tank section. The seat section includes a recessed bowl at the bottom of which is defined a discharge opening. This opening is aligned with an inlet opening of the waste holding tank section. The seat section also includes portions defining a flush water storage chamber in which fresh flush water is kept for use with the toilet. Actuation of the flush assembly causes a pumping mechanism to deliver water from the flush water storage chamber to a discharge nozzle that directs the flush water into the toilet bowl. A check valve is located in-line between the pumping mechanism and the nozzle and therefore the flush assembly, in particular the pumping mechanism, is not provided with any type of manual valve that will prevent inadvertent leaking of flush water into the toilet bowl. This simplifies the construction of the flush assembly and its associated pumping mechanism while permitting the flush assembly to be incorporated as a drop-in replacement option on portable toilets having manually operable flush assemblies.

Instead of the palm button previously associated with battery operated flush assemblies, the present invention uses a push button to close the switch of an electrical circuit and begin flushing. Thus, finger tip control and a minimum amount of manual force is required. The push button is located in a drained recess which prevents inadvertent actuation of the assembly and which allows water to be drained away from the push button.

The battery pack of the invention is carried by a housing which is readily removed from the toilet without tools and without requiring tilting or manipulation of the remainder of the toilet. The battery pack is novelly provided with an O-ring that ensures that the battery pack, battery switch and other components are readily contained within a sealed, fluid-tight enclosure that protects them from water and various other outside elements.

Additional benefits and advantages of the present invention will become apparent to those skilled in the art to which this invention relates from the subsequent description of the preferred embodiments and the append claims, taken in conjunction with the accompanying drawings.

DETAILED DESCRIPTION OF THE PREFERRED EMBODIMENT

Figure 1:
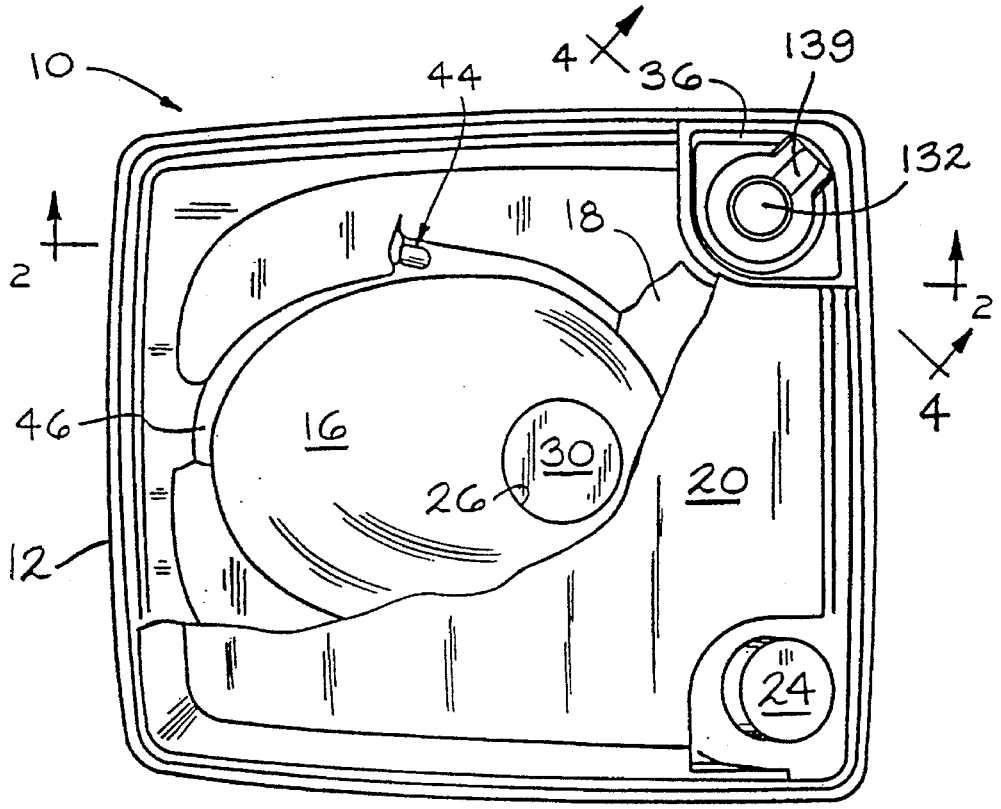
FIG. 1 is a plan view with portions broken away illustrating a portable toilet incorporating the principles of the present invention.
Figure 2:
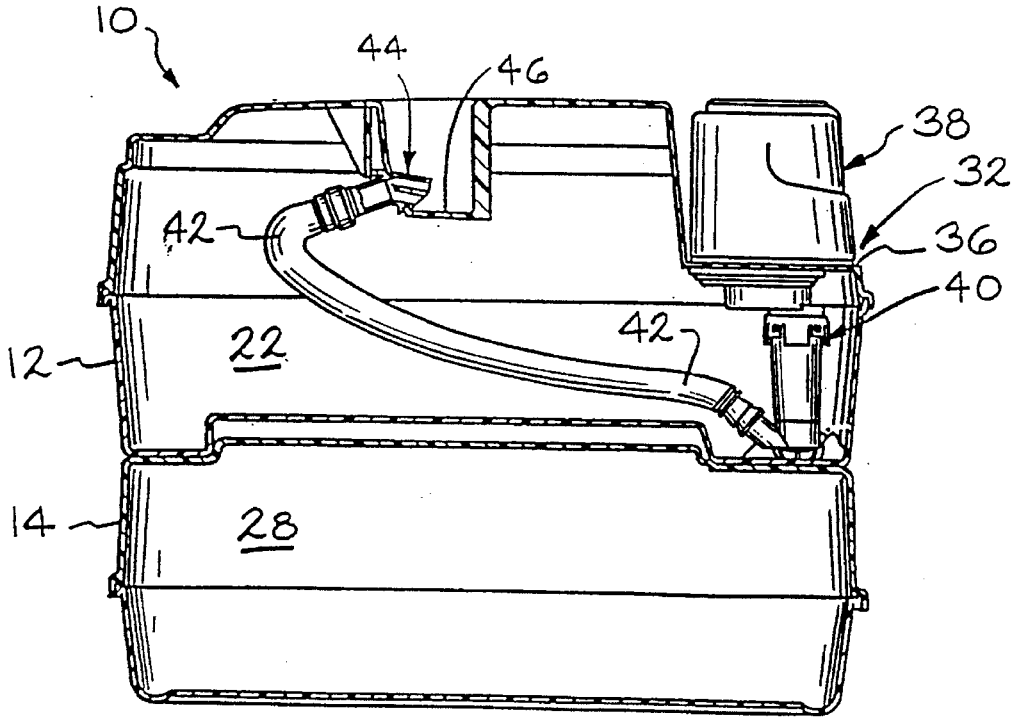
FIG. 2 is a sectional view taken substantially along the line 2—2 in FIG. 1 further illustrating features of the present invention.

Referring now to the drawing, an improved portable toilet according to the principles of the present invention is generally illustrated in FIGS. 1 and 2 and designated at 10. The toilet 10 includes a seat section 12 separably mounted onto a holding tank section 14 in a well known and conventional manner. The sectional section 12 includes a bowl 16, and overlying seat 18 and a cover 20. Both the seat 18 and the cover 20 are hingedly mounted to the rear of the seat section 12 so that they can be moved between positions covering and uncovering the bowl 16. A storage tank or chamber 22 for fresh flush water is defined within the interior of the seat section 12. A fill port covered by a removable cap 24 is provided to enable filling of the storage chamber 22 with fresh flush water.

A discharge opening 26 is located at the bottom of the bowl 16 so as to be in registry with an inlet opening (not shown) in the holding tank section 14 when the two sections are mounted to one another. The alignment of the discharge opening 26 with the opening in the holding tank section 14 permits waste to be transferred from, the bowl 16 into a waste receiving chamber 28 defined by the holding tank section 14. When the toilet 10 is not being used, the discharge opening 26 is occluded by a disc or other type of closure valve 30 that can be manipulated by the user of the toilet 10 through a linkage (not shown) of a well known variety. An electric or battery operated flush assembly 32 is provided to pump fresh flush water from the flush water source, the flush water storage chamber 22, into the bowl 16 in order to remove waste from the bowl 16. The flush assembly 32 is mounted to the seat section 12 through an opening 34 in what is illustrated as the right rear upper corner 36 of the seat section 12. The flush assembly 32 generally includes as its principal components an actuator mechanism 38, a pumping mechanism 40, a supply conduit 42 and a discharge nozzle 44.

The discharge nozzle 44 is secured to the bowl 16 and oriented so that as flush water is expelled therethrough, it is directed into and around the perimeter of the bowl 16 causing thorough wetting of the entire bowl surface. To assist in wetting the entire bowl surface, the bowl 16 is provided with a flush ledge 46. This ledge 46 extends around the upper perimeter of the bowl 16 and permits discharged flush water to flow along the perimeter of the bowl and gradually inwardly off the ledge 46.

As generally summarized above, prior RV toilets have included check valves which were typically provided adjacent to the discharge nozzle or in-line with the supply conduit so as to prevent the inadvertent passing of flush water through the conduit. These check valves have typically included a single compression spring that biased a valve disc into engagement with a valve seat when the toilet was not being flushed. Obviously, using the compression spring, as the valve disc was unseated from the valve seat, the pressure required to further move the valve disc away from the seat increased as a result of further compression of the spring. Toilets incorporating check valves of this type require the pumped flush water to exhibit a force sufficient to move and maintain the check valve in its open position.

Because handicapped, elderly, arthritic or young persons may find it difficult to operate a manual pumping mechanism which will generate the necessary force to achieve proper flushing, electric flush assemblies are becoming increasing popular. Where the electric pumping mechanism operates off of a battery, it is desirable to limit the flushing pressure which must be generated by the pumping mechanism. This is done in an effort to provide for maximum battery life. To achieve such reduced flushing pressures, a check valve 48 which requires less force to initially open and maintain opened is utilized.

Generally, this check valve 48 includes a magnet 49 which maintains a valve disc 51 in sealing engagement with a valve seat 53 through the attraction between the magnet 49 and a metal striker pin 55. Once the magnetic 49 attraction between the magnet 49 and the striker pin 55 has been broken and the check valve 48 initially opened, the in-line pressure required to maintain the check valve 48 in this opened condition reduces in response to the reduction in magnetic attraction between the magnet 49 on the valve disc 51 and pin 55 on the valve seat 53. A weak coil spring 57 is provided in the valve 48 to bias the valve disc 51 back toward the valve seat 53 so that the magnetic attraction will be reestablished between the magnet 49 and the striker pin 55 causing reengagement with the valve disc 51 with the valve seat 53. The coil spring 57 is sufficiently weak so that once the check valve 48 has been opened, only a nominal amount of in-line pressure is needed to maintain it open. The weak coil spring 57 is therefore only used to bias the check valve 48 after complete flushing has occurred. While only one specific variety of check valve 48 is described herein, it should be understood that the present invention is applicable with any check valve 48 that will require a minimal amount of force to maintain open during flushing.

As seen in FIG. 2, the check valve 48 is integrally or unitarily formed with the discharge nozzle 44. Obviously, the check valve 48 could be constructed separate from the discharge nozzle 44 and positioned entirely or partially within the supply conduit 42 without departing from the teachings of this invention.

The supply conduit 42 extends from the check valve 48 and discharge nozzle 44 to the pumping mechanism 40 where it is secured to a discharge fitting 50 by a clamp 52 or other securement method or mechanism. The pumping mechanism 40 is an electric pump wholly located within the flush water storage chamber 22 of the seat section 12. The pumping mechanism 40 is positioned within the flush water storage chamber 22 so that its water inlet 54 is located at a lowermost flush water collection area 56 in the storage chamber 22. Circumferentially spaced about the lower end of the pumping mechanism 40 are vanes 58. The vanes 58 help to limit movement of the pumping mechanism's 40 lower end by surrounding and contacting the pump housing 60. The upper end of the pump housing 60 is secured about an opening 62 by a mounting portion 63 in a lower battery housing 64. Mounting is done through engagement of a shoulder 66 within a slot 68 defined within a resiliently deflectable tab 70 of the mounting portion. A flange 72 is defined around the pump housing 60, at its upper end, for receiving an O-ring 74. When the housing 60 is properly engaged with the lower battery housing 64, the O-ring 74 becomes trapped between the flange 72 and a shoulder 76 defined around the opening 62 of the lower battery housing 64 and forms a fluid tight seal therebetween.

The pumping mechanism 40 includes an electric motor 78 (shown in phantom) which rotates a shaft 80 having an impeller 82 mounted on its end. The impeller 82 causes flush water to be drawn in through the inlet 54 from the storage chamber 22 and discharges the flush water through the discharge fitting 50 and the discharge nozzle 44. To enable operation of the motor 78 and flushing of the toilet 10, the motor 78 is connected by a wire lead 84 and terminal 86 to the actuator mechanism 38.

To power the electric motor 78 of the pumping mechanism 40, electricity is provided by a battery pack 88 contained within the actuator mechanism 38 as further described below. The actuator mechanism 38 also includes the lower battery housing 64 mentioned previously and an upper battery housing 90. The lower battery housing 64 is mounted to the seat section 12 at the opening 34 so as to extend into the flush water storage chamber 22 where it supports the pump housing 60. The upper battery housing 90, however, is mounted so that it is located on the exterior of the seat section 12 immediately above the lower battery housing 64.

A support flange 92 of the lower battery housing 64 extends around the perimeter of the opening 34 and contacts the exterior of the seat section 12. A cylindrical portion 94 extends downward from the support flange 92 through the opening 34 and terminates in the mounting portion 63. To secure the lower battery housing 64 to the seat section 12, a pair of retaining ribs 96 and 98 are formed on the outer surface of the cylindrical portion 94. The ribs are spaced apart from one another and define a groove 100 into which that portion of the seat section 12 defining the opening 34 is received. The opening 62 through which extend the wire leads 84 to the motor 78 is defined in a floor 102 of the lower battery housing 64 from which the mounting portion 63 for the pump housing 60 depends.

Figure 3:
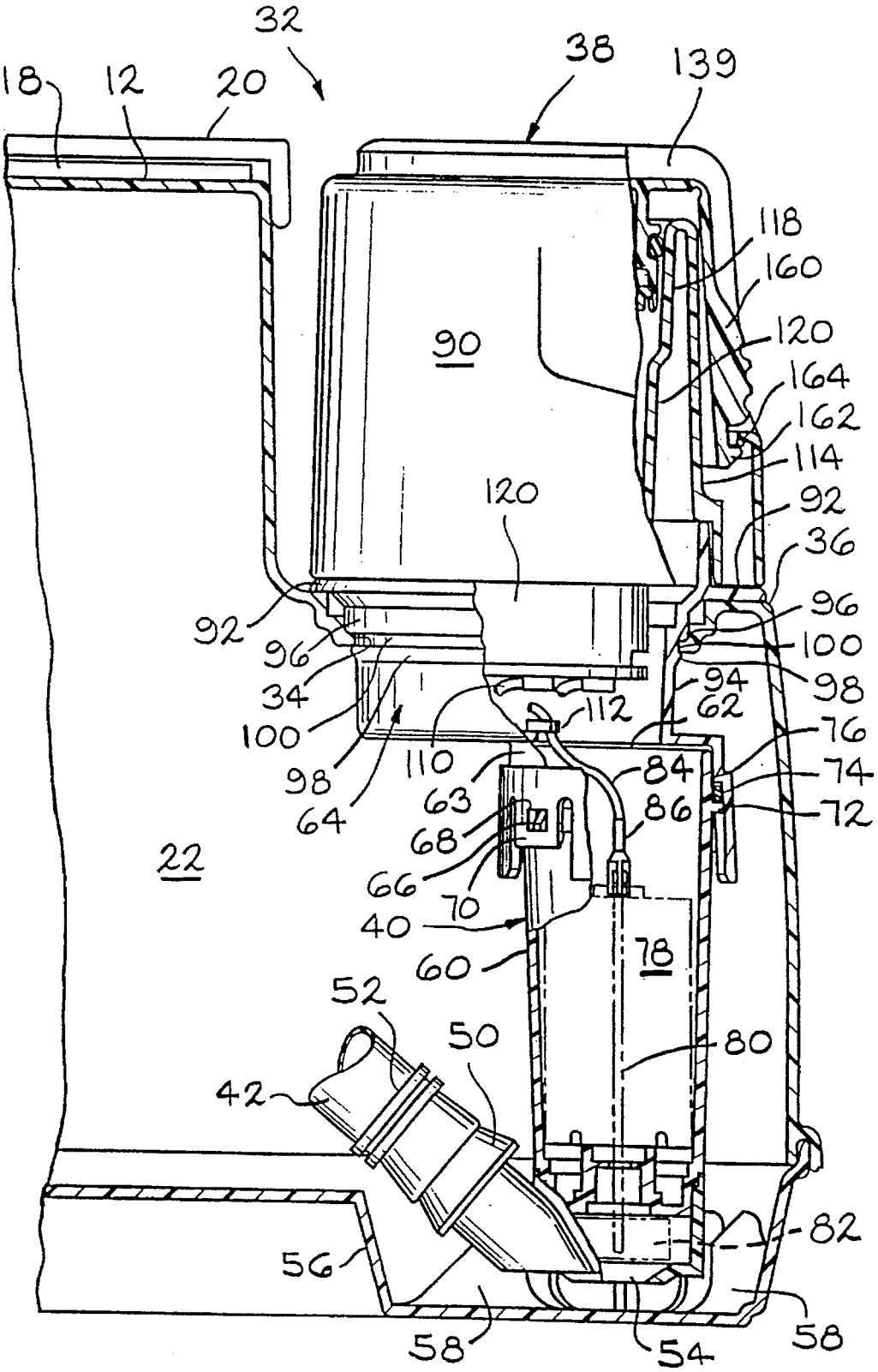
FIG. 3 is an enlarged sectional view of the flush assembly illustrated in FIG. 2 with portions of the actuation mechanism and flushing mechanism also being shown in section.
Figure 4:
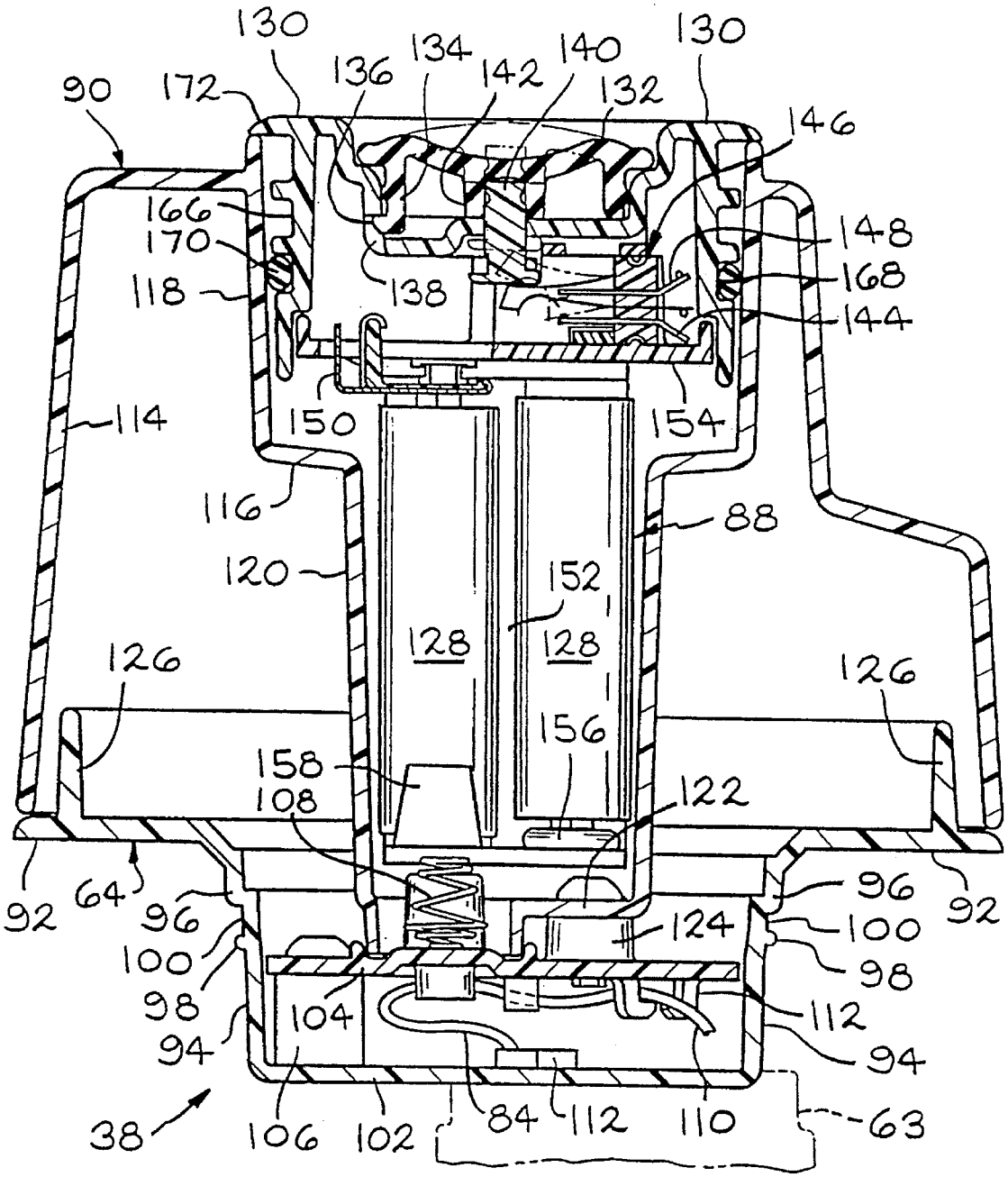
FIG. 4 is a sectional view taken substantially along line 4—4 in FIG. 3 of the actuation mechanism and battery pack utilized in the present invention.
Figure 5:
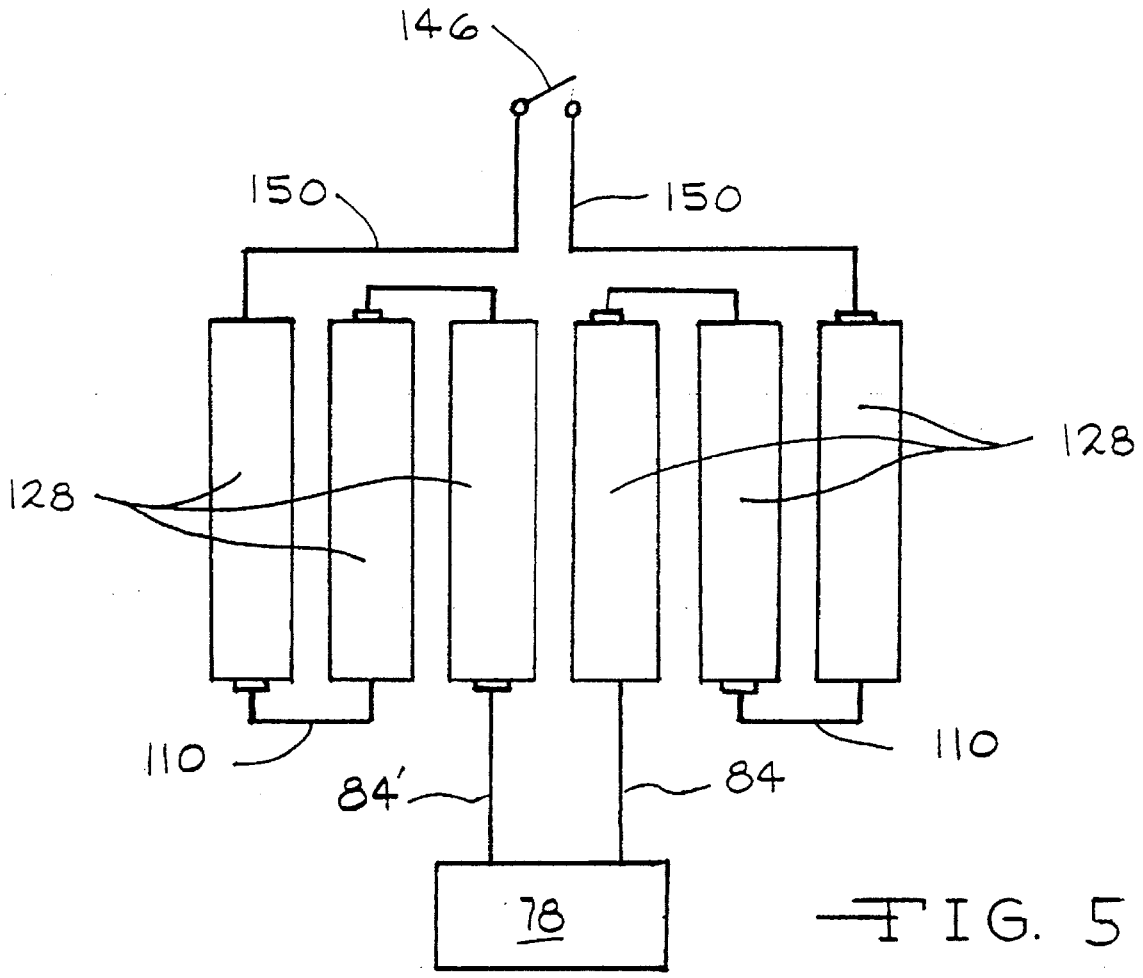
FIG. 5 is a schematic illustration of the electrical circuit employed with the present invention.
Figure 6:
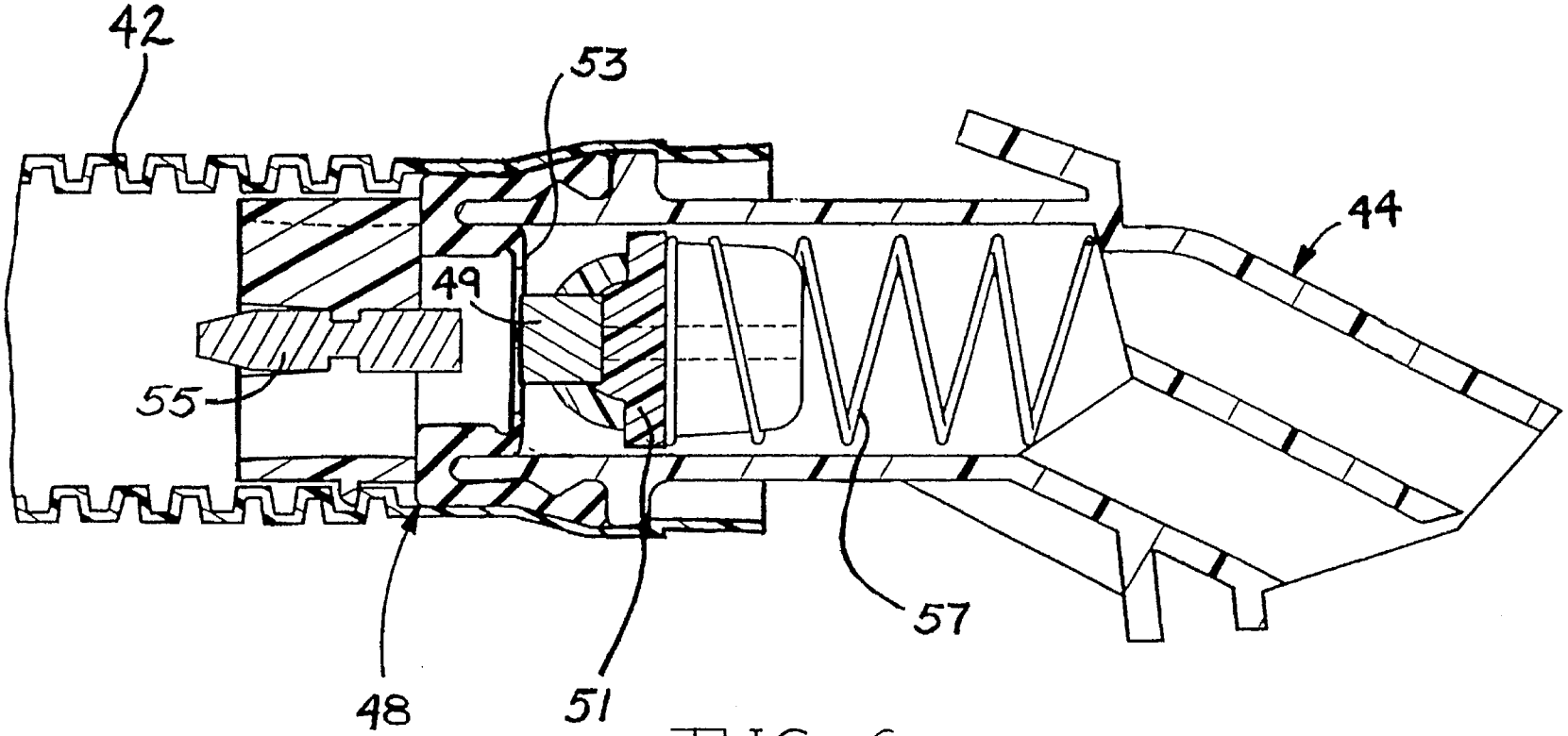
FIG. 6 is a sectional view of a check valve as used in the present invention.

As best seen in FIG. 4, the floor 102 and the cylindrical portion 94 cooperate to define a recessed area located partially within the, storage chamber 22. A contact plate 104 is secured within the recessed area by one or more mounting bosses 106. The contact plate 104 itself supports several spring terminals 108 which are positioned to engage the battery pack 88 and which are secured to the contact plate 104 through the use of rivets or other mounting bosses. For the sake of clarity, only a representative number of the spring terminals 108 and wire leads 110 and 84 are illustrated in FIGS. 3 and 4 and schematically in FIG. 5. As one skilled in the art will readily appreciate, alternative electrical setups from those illustrated can be made and will depend the specifics of the battery pack 88 and other factors. To permit an easy wiring layout, the contact plate 104 and the floor 102 are provided with wire retaining clips 112.

The upper battery housing 90 is unitarily formed and includes an exterior skirt 114 and an interior well 116. The well 116 is defined by an upper portion 118 and a lower portion 120. The well's bottom is a base plate 122 which cooperates with mounting bosses and plugs provided on the contact plate 104 of the lower battery housing 64 to secure the upper battery housing 90 in place. As seen in FIG. 4, the skirt 114 extends from the upper portion 118 of the well 116, outward and downward until terminating at a point where it contacts the perimeter of the support flange 92 generally outside of an upright wall 126. The wall 126 operates as an additional barrier in preventing casual water from the exterior of the toilet 10 from entering into the actuation assembly 38.

The well 116 exhibits a different shape between its upper portion 118 and its lower portion 120. The lower portion is generally rectangular in horizontal cross sectional shape so that it can accommodate two rows of batteries 128. The specific type and actual number of batteries 128 need not be specified herein because, as one skilled in the art will appreciate, numerous different configurations can be used without departing from the present invention. Six batteries 128 are illustrated in the schematic drawing of FIG. 5. In particular, these considerations will depend upon the size of the motor 78 used in the pumping mechanism 40.

The upper portion 118 exhibits a round horizontal cross sectional shape. As will be seen in the discussion which follows, this allows for a simplified construction and better sealing of the battery pack 88 to protect it from casual water, other elements and dirt.

The battery pack 88 is provided so that it can be readily removed from the remainder of the actuation mechanism 38 of the toilet 10 allowing the batteries 128 to be easily and quickly replaced. The battery pack 88 includes a button housing 130 with a recessed central region in which a deflectable button 132, of rubber or another resilient material, is received. The recessed region or recess is of a depth which inhibits inadvertent actuation of the button 132. The button 132 can be depressed to move it between a non-actuation position (shown in phantom) and the actuation position illustrated in FIG. 4. Common methods are used to retain the button 132 within the central recess of the housing 130. As illustrated, the button 132 is provided with a circumferentially downward extending wall 134, a portion of which terminates in a deflectable finger 136 which engages a cut-out 138 in the housing 130.

The recess of the button housing 130 is also provided with portions defining a drain 139. The illustrated drain 139 is an open area to, one side of the housing 130 which allows casual water to drain out of the recess and away from the button 132. Obviously, the recessed portion can be provided with other types and varieties of passive drains including, but not limited to, passages, holes or other openings in the button housing 130.

On its underside, the button 132 receives and retains an extension or pin 140 within a retaining boss 142. The pin 140 extends through the recessed portion of the housing 130 and engages one terminal 144 of a switch 146. When the button 132, and therefore the pin 140, is depressed, the terminal 144 engaged by the pin 140 is moved into electrical contact another terminal 148 of the switch 146 establishing a closed electrical circuit between the batteries 128 and the motor 78. The result is flush water being expelled through the discharge nozzle 44 of the toilet 10. The switch 146 itself need not be described in greater detail because numerous alternative and well known constructions could readily be incorporated as the switch 146 in the present invention. At least one of the switch terminals 144 or 146 is electrically coupled to a contact 150 engaged with the series of batteries 128.

A retainer plate 154 is mounted to the button housing 130 and operates as a mounting surface for the switch 146 and a battery holder 152. The battery holder 152 extends from the retainer plate 154 downward into the lower portion 120 of the well 116 and is provided with terminals 156 on its lower end which will engage the batteries 128 with the spring terminals 108 of the lower battery housing 64. To permit easy removal of dead batteries 128 from the battery pack 88 and their replacement with new batteries 128, the battery holder 152 is formed with resilient clips 158 which engage the sides of the batteries 128 to retain them in contact with the various terminals 150 and 156 on the holder 152. In FIG. 4, only one battery 128 is shown in contact with the terminal 156 of the battery holder 152 and only one battery 128 is shown being retained by a battery clip 158.

Because the batteries 128 may need to be replaced "in-the-field," the battery pack 88 must be easily removed from the remainder of the toilet 10. To permit removal, the button housing 130 includes a resilient latch 160 unitarily formed therewith. The latch 160 has a catch or shoulder 162 formed on a deflectable end so that it will engage a lip 164 formed on the upper battery housing 90 when the two are properly aligned and the battery pack 88 is fully inserted into the well 116. Therefore, to remove the battery pack 88 and change the batteries 128 of the actuation mechanism 38, the latch 160 is depressed, disengaging the catch 162 from the lip 164, and the battery housing 130 upwardly withdrawn, removing with it the battery holder 152 and batteries 128 from the lower portion 120 of the upper battery housing 90. The exhausted or dead batteries 128 can then be easily removed from the holder 152, replaced with fresh batteries 128 and the battery pack 88 reinserted into the upper battery housing 90. It is not necessary to use tools or upset the toilet 10 in order to replace the batteries 128.

With the battery pack 88 reinstalled, water, did and other foreign objects are inhibited from entering the well 116 by the sealing engagement established between the button housing 130 and the upper battery housing 190. This is achieved by providing the button housing 130 with a dependent circumferential wall 166 in which is formed at least one groove 168. The groove 168 is dimensioned with respect to the annular upper portion 118 of the well 116 so that a properly sized O-ring 170 can be received and retained therein. The O-ring 170 forms a positive seal between the battery housing 90 and the button housing 130. In forming the upper portion 118 in an annular or circular fashion as described above, the ability to use an O-ring 170 to form this seal is made possible even through the remainder of the battery pack 88 is not provided with this round or annular configuration. As an additional sealing feature, the button housing 130 includes a perimeter flange 172 which forms a "roof" over the opening defined by the upper portion 112 of the well 116 shielding any gap therebetween.

While the above description constitutes the preferred embodiments of the present invention, it is to be understood that the invention is not intended to be limited to the exact construction or method illustrated and described above, but that various changes and modifications may be made without depending form the spirit and scope of the invention as defined in the following claims.

We claim:

1. A flush assembly for a portable toilet having a bowl with a bottom discharge opening, the toilet also including a flush water chamber adapted to contain flush water for rinsing the bowl and flushing the contents thereof through the discharge opening, said flush assembly comprising: an electric pump operable to pump flush water from the flush water chamber into the bowl, said pump having a pump inlet located in the flush water chamber and a pump outlet communicating with the bowl, a flush assembly housing mounted to the toilet, a battery pack for supplying electrical power to said pump to operate said pump, said battery pack being removably received within a portion defining a recess in said flush assembly housing, said battery pack also including a battery pack housing, said battery pack housing having a battery holding portion and supporting an actuating member both being removable with said battery pack, said battery pack holding portion adapted to secure at least one battery therein, said actuating member being electrically connected to said battery pack and said pump for selectively actuating said pump in response to actuation of said actuating member, said battery pack adapted to permit removal of batteries from said battery holding portion without requiring removal of said actuating member from said battery pack housing, valve means connected to said pump for preventing inadvertent flow of flush water into the bowl, conduit means for connecting said valve means to said pump outlet, said conduit means providing unrestricted communication between said pump outlet and said valve means, said valve means operating to permit flow of flush water into the bowl in response to pumping of flush water by said pump out of said pump outlet.

2. The flush assembly of claim 1 wherein said valve means requires a reduced force to be maintained open relative to a force required to initially open said valve means.

3. The flush assembly of claim 1 wherein said valve means is a check valve.

4. A flush assembly for a portable toilet having a bowl with a bottom discharge opening, the toilet also including a flush water chamber adapted to contain flush water for rinsing the bowl and flushing the contents thereof through the discharge opening, said flush assembly comprising: an electric pump operable to pump flush water from the flush water chamber into the bowl, said pump having a pump inlet located in the flush water chamber and a pump outlet communicating with the bowl, a flush assembly housing mounted to the toilet, a flush assembly recess defined in said flush assembly housing, a battery pack coupled to supply electrical power to said pump to operate said pump, said battery pack being received within said flush assembly recess and being removably mounted to said flush assembly housing, said battery pack including a battery pack housing having a battery holding portion adapted to secure at least one battery therein, said battery pack also including an actuating member supported by said battery pack housing, said actuating member being electrically connected to said battery holding portion and said pump for selectively actuating said pump in response to movement of said actuating member, said actuating member being located in an actuator recess in said battery pack housing to prevent inadvertent actuation of said actuating member, said actuator recess including portions defining a drain allowing the drainage of water out of said actuator recess, valve means connected to said pump for preventing inadvertent flow of flush water into the bowl, conduit means for connecting said valve means to said pump outlet, said conduit means providing unrestricted communication between said pump outlet and said valve means, said valve means operating to permit flow of flush water into the bowl in response to pumping of flush water by said pump out of said pump outlet.

5. A flush assembly for a portable toilet having a bowl with a bottom discharge opening, the toilet also including a flush water chamber adapted to contain flush water for rinsing the bowl and flushing the contents thereof through the discharge opening, said flush assembly comprising: an electric pump operable to pump flush water from the flush water chamber into the bowl, said pump having a pump inlet located in the flush water chamber and a pump outlet communicating with the bowl, a flush assembly housing mounted to the toilet, a flush assembly recess defined in said flush assembly housing, a battery pack coupled to supply electrical power to said pump to operate said pump, said battery pack being received within said flush assembly recess and being removably mounted to said flush assembly housing, said battery pack including a battery pack housing having a battery holding portion adapted to secure at least one battery therein, said battery pack also including an actuating member supported by said battery pack housing, said actuating member being electrically connected to said battery holding portion and said pump for selectively actuating said pump in response to movement of said actuating member, said actuating member being located in an actuator recess in said battery pack housing to prevent inadvertent actuation of said actuating member, valve means connected to said pump for preventing inadvertent flow of flush water into the bowl, conduit means for connecting said valve means to said pump outlet, said conduit means providing unrestricted communication between said pump outlet and said valve means, said valve means operating to permit flow of flush water into the bowl in response to pumping of flush water by said pump out of said pump outlet.

* * * * *